United States Patent [19]

Hertel

[11] 4,401,503

[45] Aug. 30, 1983

[54] APPARATUS FOR THIS APPLICATION OF AN ADHESIVE WEB LONGITUDINALLY AND WITH U-SHAPED SECTION ABOUT THE EDGE OF A SHEET METAL PANEL OR THE LIKE SHAPED PART OF SHEET METAL

[75] Inventor: Helfried Hertel, Lörrach, Fed. Rep. of Germany

[73] Assignee: Ciba-Geigy Corporation, Ardsley, N.Y.

[21] Appl. No.: 407,523

[22] Filed: Aug. 12, 1982

[30] Foreign Application Priority Data

Aug. 17, 1981 [CH] Switzerland ..... 5301/81

[51] Int. Cl.[3] ..... B65H 31/00

[52] U.S. Cl. ..... 156/461; 156/201; 156/202; 156/216; 156/463; 156/464; 156/468

[58] Field of Search ..... 156/443, 461, 463–467, 156/468, 475, 486, 200–202, 204, 226, 227, 216, 577

[56] References Cited

U.S. PATENT DOCUMENTS

| | | | |
|---|---|---|---|
| 2,219,678 | 10/1940 | Bosch | 156/468 X |
| 2,749,966 | 6/1956 | Roetger | 156/464 X |
| 2,916,079 | 12/1959 | Schiefer | 156/216 X |
| 3,733,237 | 5/1973 | Wolff | 156/468 |
| 3,886,013 | 5/1975 | Bowser | 156/468 X |
| 4,155,798 | 5/1979 | Becker | 156/416 X |

*Primary Examiner*—David A. Simmons
*Attorney, Agent, or Firm*—Harry Falber

[57] ABSTRACT

An adhesive web is to be pressed on to the edge of a shaped sheet metal part, so that the web portion on the metal part has a U-shaped cross-section. To this end, the adhesive web is first peeled off a carrier tape and is then folded with the aid of a deflecting and pre-folding roller having a profile whose cross-section is a wide V. The pre-folded web is then folded further continuously in a funnel-shaped pre-folding channel.

The sheet metal part whose edge is to be covered is then introduced with that edge, within the reach of the pre-folding channel, into the folded bend of the adhesive web, and both the sheet metal part and the web thereon are conveyed together by a pair of feed and press-on rollers which press the adhesive web on the edge and sides of the sheet metal part.

13 Claims, 3 Drawing Figures

APPARATUS FOR THIS APPLICATION OF AN ADHESIVE WEB LONGITUDINALLY AND WITH U-SHAPED SECTION ABOUT THE EDGE OF A SHEET METAL PANEL OR THE LIKE SHAPED PART OF SHEET METAL

BACKGROUND OF THE INVENTION

This invention relates to an apparatus for applying an adhesive web longitudinally and with U-shaped section about the edge of a panel or the like shaped part of sheet metal, which apparatus is equipped with web-guiding means comprising a funnel-like pre-folding channel, a pair of feed and press-on rollers each of which rollers comprises a feed roller shaft being spring-biassed to press one roller against the other, said two feed and press-on rollers being adapted for receiving between them a pre-folded adhesive web emerging from said pre-folding channel and for pressing said pre-folded adhesive web against an edge and against opposite sides adjacent said edge, of a panel or the like shaped part of sheet metal, while said part is being introduced into contact with said folded adhesive web.

In sheet metal-processing industries, pressure- or heat-hardenable adhesive tapes are widely used to paste over folded seams connecting metal parts with each other. Thus, it is customary in the automobile industry to seal in this manner folded seams of certain automobile body parts, in particular doors, and thereby to avoid the danger of corrosion.

In the automobile industry and similar branches of industry, there are usually employed adhesives in liquid or pasty form for producing such pasted-over folded seam joints, which adhesives are applied to the sheet metal parts to be joined in the form of a cord. This method of applying adhesive is unsatisfactory in several respects. One such drawback is seen in the fact that the distribution of the adhesive, attained by this method, over the entire folded seam is not sufficiently uniform, which fact may cause problems of corrosion, and, as another drawback, the use of adhesives in liquid or pasty form always causes problems of work hygiene.

In the manufacture of cans for preserving food and the like, it is also conventional to paste over folded seams or seal them with adhesives, by methods described, for instance, in U.S. Pat. No. 3,125,056, French patent application Publication No. 2,252,147 or Belgian Pat. No. 444,014. The adhesive is applied in these cases to the crimped edges of the parts of the can body being connected with one another, either in liquid or pasty form, by extrusion or like methods, in the form of strips of an adhesive tape.

Adhesives such as Araldit or Redux adhesives marketed by Ciba-Geigy AG, Basel, Switzerland, in the shape of foils or webs, are increasingly used, especially because of their advantages of safe applicability, satisfying the demands of work hygiene. However, in the past, such adhesive foils or tapes have only found very limited use, or no use at all, for sealing or pasting-over folded seams, e.g., of automobile body parts.

This is due to the fact that these adhesive webs are highly cohesively plastic (of high viscosity) and that their low tensile strength causes considerable difficulties in applying them mechanically. Additional complications arise when such strips of adhesive foils must be applied to parts of automobile bodies whose folded seams have a complicated configuration, in particular one that is curved tridimensionally. These difficulties are especially great when a crimped rim is to be provided with adhesive on both sides thereof, i.e. when the adhesive web is to be laid about the rim with a U-shaped web cross-section.

The hitherto known apparatus of the initially described type are only suitable for processing relatively stiff adhesive tapes of considerable tensile strength. This is, for instance, the case of an apparatus described in U.S. Pat. No. 4,155,798 which comprises a pre-folding channel and press-on rollers. Adhesive webs which, in contrast to adhesive tapes, must be applied after separation from a carrier web or tape, cannot be applied successfully in this and other known apparatus.

The known apparatus of the type described in U.S. Pat. No. 4,155,798 comprise free-wheeling press-on rollers. In other apparatus, especially those of the type in which Bristol board and the like drawing paper is to be provided with a border of adhesive tapes, these press-on rollers are rigidly coupled with a driving motor.

OBJECTS AND SUMMARY OF THE INVENTION

It is therefore an object of the invention to provide an apparatus for applying adhesive webs of low inherent stiffness and tensile strength (from which any carrier webs or tapes have been peeled off, and which have been folded), longitudinally and with U-shaped cross-section about the edge of a sheet metal panel or the like part; according to another object of the invention such apparatus should be free from the above-described drawbacks of the known apparatus, and in particular of those drawbacks which would occur if the known apparatus were used to apply adhesive webs of the above-described characteristics instead of the adhesive tapes that are conventionally applied with the aid of these apparatus; yet another object of the invention is to provide an apparatus of the above-described type which is suited for applying adhesive web of the above-defined nature to the edges of metal sheet parts comprising spatially curved portions.

These objects are attained, in accordance with the present invention, in an apparatus of the initially-described type which comprises bearing means on which the initially-mentioned pair of feed and press-on rollers is pivotally mounted to be swivable as a unit about a common swivel shaft, which swivel shaft has a longitudinal axis which extends parallel to the shafts of the said feed and press-on rollers and is located, ahead of the said roller pair (taken in the direction of travel of said sheet metal part and adhesive web between the feed and press-on rollers of the said pair) at least approximately in the horizontal plane of symmetry of the initially-mentioned pre-folding channel, while the feed and press-on rollers are drivable by motor means and exert on the sheet metal part, being pulled through the said unit by the feed and press-on rollers, an at least approximately constant force of conveyance even when differences occur between the speeds of the two rollers of the said pair.

This invention is distinguished from the prior art apparatus by the above-mentioned features, in contrast to the known apparatus of the initially-described type in which a satisfactory application of highly cohesively plastic adhesive webs of low inherent rigidity and low tensile strength failed to be obtained due to the rigid mutual arrangement of the pre-folding channel means and the feed and press-on rollers. Moreover, it was recognized that, whether or in which manner these rollers were driven, played an important part in achieving a successful application in order to satisfy the above-listed objects.

In a preferred embodiment of the apparatus according to the invention, the distance of the said swivel axis (of said unit consisting of said roller pair) from a common plane extending through the axes of both roller shafts or the roller pair is at least approximately equal to the distance between the said common plane and the exit end of the pre-folding channel. Preferably, the said unit of feed and press-on rollers is held resiliently in a neutral position relative to the exit end of the pre-folding channel, and has a unit plane of symmetry, extending between the two rollers of the said pair, which coincides, in the said neutral position, with the horizontal plane of symmetry of the pre-folding channel.

The apparatus according to the invention can further comprise a web-deflecting roller which is so arranged directly ahead of the pre-folding channel, in the direction of travel of the adhesive web, that it acts as a pre-folding roller on the said adhesive web guided by the same. The pre-folding roller preferably bears a profile which is weakly arcuate or V-shaped, and the said profile has a large profile angle enclosed by said arc or V, with the zone of smallest diameter being in the middle of the peripheral face of the pre-folding roller. The said profile angle is preferably about 155° to 165°.

The pre-folding channel preferably has a V-shaped cross-sectional area and the angle between the legs of the V is from about 90° to 100° at the entry end, and from about 10° to 15° at the exit end of the pre-folding channel.

The effective channel length for the passage of the adhesive web through the pre-folding channel while it is pre-folded therein, preferably amounts to from about 60% to 80% of the effective width of the deflecting and pre-folding roller.

A preferred embodiment of the apparatus according to the invention can further possess drive means comprising a common motor for driving the feed and press-on rollers of the said pair, and at least one elastically twistable element coupled to the motor and drivingly connected to one of the said rollers of the pair. This elastically twistable element is preferably a flexible and torsionally elastic shaft. At least one of the two feed and press-on roller shafts can be pivotally supported in the said unit about a shaft pivot axis, and the unit then preferably comprises a spring urging the roller of the pivotally supported shaft against the other roller; the position of the shaft pivot axis is preferably so adjustable that at a given distance of the rollers of the pair from one another the two roller shafts are exactly parallel with each other.

As further preferred features, the web guiding means comprise a biassing spring and means for displacing the deflecting and pre-folding roller relative to the pre-folding channel, in a direction transverse to the path through which the adhesive web travels when passing from the entry end to the exit end of the pre-folding channel, which biassing spring urges the deflecting and pre-folding roller toward the said path of travel of the adhesive web. The direction of displacement of the deflecting and pre-folding roller is then at least substantially parallel to the roller shafts of the feed and press-on rollers.

BRIEF DESCRIPTION OF THE DRAWINGS

Other objects and details of the invention will become apparent from the further description thereof in connection with the accompanying drawings in which.

DESCRIPTION OF THE EMBODIMENT SHOWN IN THE DRAWINGS

Figure 1:
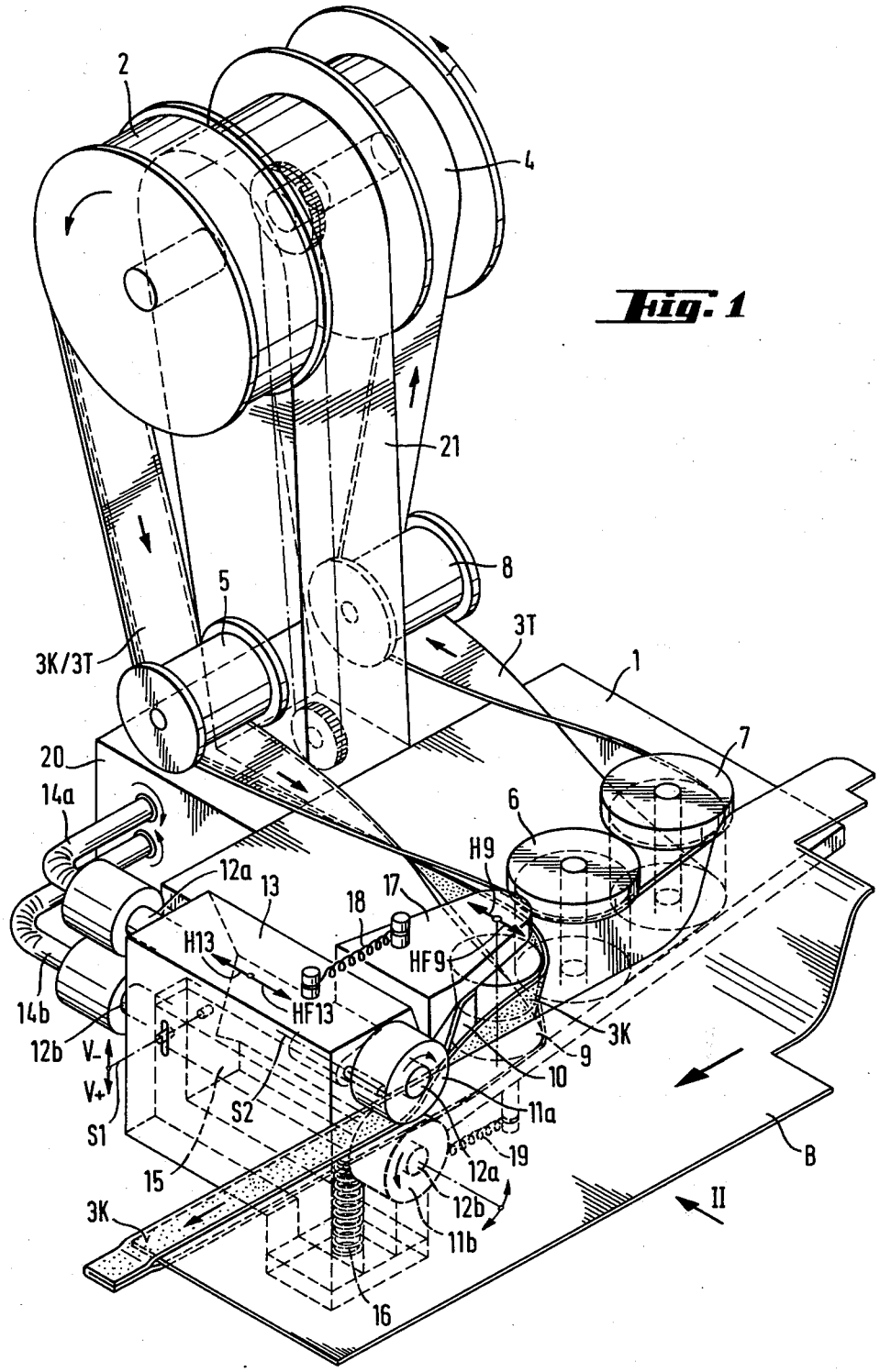
FIG. 1 shows schematically and in perspective a view, from the left, of a preferred embodiment of the apparatus according to the invention.

The illustrated embodiment of the apparatus according to the invention is supported on a bottom plate 1 and comprises a storage reel 2 bearing a composite adhesive web-cum-carrier web 3K/3T, a wind-up reel 4 on which the carrier web 3T is wound up after being separated from the adhesive web 3K, four deflector rolls 5 to 8, a deflector and pre-folding roller 9, a funnel-shaped pre-folding channel means 10 and a pair of feed and press-on rollers **11*a*, 11*b*. The reference numeral 20** designates a box which contains conventional drive means comprising an electric motor and transmission means.

Each of the two feed and press-on rollers is mounted on its respective shaft **12*a*, 12*b*, which shafts 12*a* and 12*b* are rotatably supported in a casing 13 and are connected respectively via flexible and elastically twistable shafts 14*a* and 14*b* to the drive means in the box 20. The shaft 12*b* of the lower roller 11*b* is supported pivotally on a swivel arm 15 (indicated by dashed lines) having the swivel shaft S1. Near the zone in which that end of the arm 15 which bears the lower feed roller 11*b*, is lodged in the wall of the casing 13, a pressure spring 16, mounted with its one end on the bottom of the casing 13, engages the underside of the arm 15 and thus urges the lower feed roller 11*b* upward toward contact with the upper feed roller 11*a***.

The swivel shaft S1 is so adjusted or adjustable that the roller shafts **12*a* and 12*b* extend exactly parallel with one another as the sheet metal panel and the adhesive web 3K pass through between the two feed rollers 11*a*, 11*b*. For this purpose, the swivel shaft S1 can be displaced in the direction of the arrow V+ to provide a greater distance of the feed rollers 11*a*, 11*b* from each other, or in the direction of the arrow V− to provide a narrower distance between the two rollers 11*a*, 11*b*, and these rollers can then be set in the desired position relative to one another. The pressure of the spring 16** can be adjusted by pressure-adjusting means (not shown) which are well known per se.

The casing 13 as a whole is mounted pivotally on the bottom plate 1 or preferably on the bearing block 17 of the deflecting and pre-folding roller 9. The swivel axis S2 of this pivotable connection extends parallel with the rotary shafts **12*a* and 12*b*, of the feed rollers 11*a* and 11*b* and is, moreover, arranged in such a manner that it lies, at least approximately, in the same plane as the central longitudinal axis of the pre-folding channel means 10, which extends through the discharge opening 10*b* of the latter, while channel means 10 are likewise fastened on the bearing block 17. Preferably, this swivel axis S2 intersects the aforesaid central longitudinal axis in the discharge opening 10*b* itself or shortly before or after that opening, with regard to the direction of travel of a sheet metal panel or band B through that opening, i.e., it can be farther from, or nearer to, the feed roller pair 11***a*, 11*b*. *This direction of travel is indicated by an arrow at the right hand end of the path of the sheet metal panel B, indicated by a line of long dashes in FIGS. 2 and 3.*

Figure 2:
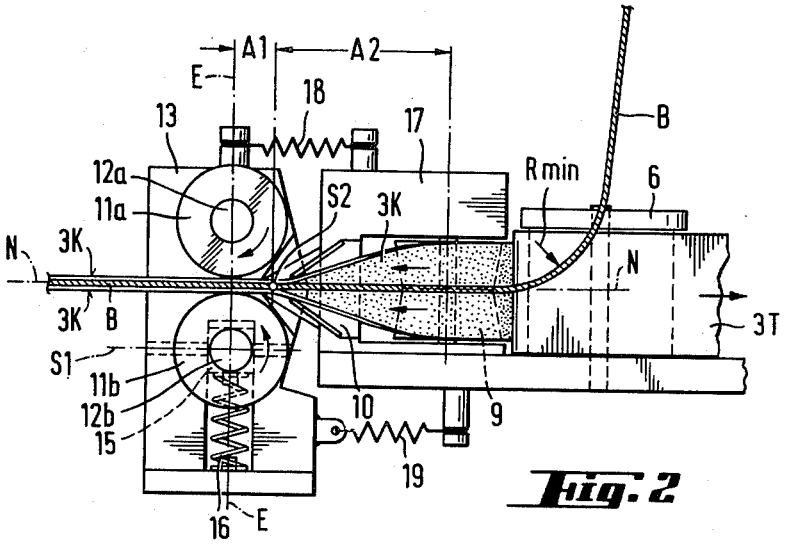
FIG. 2 is a frontal view of a detail of the embodiment shown in FIG. 1, taken in the direction of an arrow II therein.

The casing 13 is biassed toward a central or neutral position, as shown in FIG. 2, by two coil springs 18 and 19 each with one of its ends fastened to the bearing block 17 and its other end fastened to corresponding conventional means, respectively, at the top end face and at the lower end of the casing 13. These tensioning springs 18 and 19 act in opposite sense on the portions of the casing 13 to which they are attached. In the neutral position N, the plane of symmetry of the feed roller pair 11*a*, 11*b*, extending between the two rollers thereof, coincides with the horizontal plane of symmetry in which the central longitudinal axis of the pre-folding channel means 10 extends.

The casing 13 is displaceable, against the bias of a return spring (not shown), along the axis S2. It can be displaced in its entirety against the bias of this return spring rearwardly, in the direction in which the roller shafts 12*a* and 12*b* extend, as indicated by an arrow H13 in FIG. 1. As is also shown in FIG. 1, forward displacement, indicated by an arrow HF13, is limited by a stop.

This displaceability of the casing 13 is indicated in FIG. 1 by a double arrow H13-HF13, with the direction of the arrow HF13 symbolizing the biassing effect of the return spring. The spring itself has not been shown for greater clarity of the drawing. Of course, the displaceability of the casing 13 can also be provided by other known means.

Figure 3:
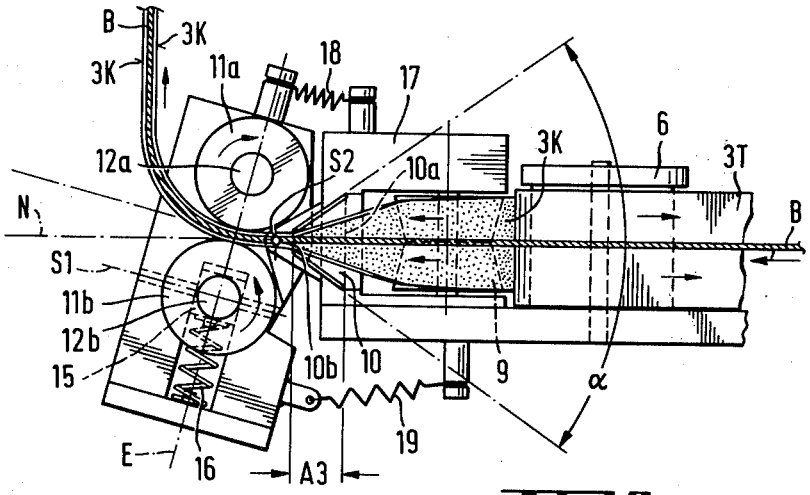
FIG. 3 shows the same frontal view, however with the parts in a different operational position.

The deflecting and pre-folding roller 9 and the pre-folding channel 10 are so devised that they fold the adhesive web 3K about its longitudinal axis to give the same a V-shaped cross section. For this purpose, the roller 9 has the profile of a flat V. The angle of the V is preferably about 155° to 165° as shown in FIGS. 2 and 3. The V-shaped profile of the roller 9 can also be replaced by a corresponding arcuate profile.

In accordance with a preferred embodiment thereof, the deflecting and pre-folding roller 9 is rearwardly displaceable, from a forward limiting stop position, against the bias of a second biassing spring (not shown), in a similar manner as is the casing 13. For the sake of clarity of the drawing, this arrangement is only symbolized by a double arrow H9-HF9 in FIG. 1, with the arrow HF9 indicating the direction in which this second return spring biasses the roller 9.

The construction of this arrangement can be effected in practice, for instance, by supporting the roller 9 in a fork-shaped member which is in turn displaceably supported, against the bias of a third biassing spring, in guide means (not shown) which are mounted on the bottom plate 1 or on the bearing block 17. The direction of displacement of the deflecting and pre-folding roller 9 need not be absolutely parallel with that of the casing 13. It must, however, be located within the angle formed by the entry path and the exit path of the deflected adhesive web 3K and permit yielding of the roller 9 in rearward direction, in relation to the feed rollers 11*a* and 11*b*. Preferably, this direction of backing-away displacement of the roller 9 can be set as desired, or at least adjusted.

The pre-folding channel means 10 is mounted on the bearing block 17 preferably in a manner permitting setting a desired position and adjustment thereof. It has an essentially V-shaped cross section, in the same way as has the deflecting and pre-folding roller 9, with the difference that the angle between the legs of the V continuously decreases from the web entry end 10*a* toward the web exit or discharge opening 10*b*, as in the case of a funnel. At its apex line, that is the line connecting all V-apices, the cross-sectional area is correspondingly rounded off-Preferably, the V-angle is about 90° to 100° at the entry end 10*a*, and about 10° to 15° at the exit end 10*b*. The rounded portion in the apex of the profile merges tangentially with the legs of the V. The radius of curvature of the rounded-off zone at the exit end 10*b* is only a few millimeters, and preferably about 3 mmm. Seen in top view, the pre-folding channel means 10 is likewise V-shaped, with the aperture angle $\alpha$ being about 70°. The effective width at the entry end 10*a* is approximately equal to the bredth of the roller 9.

The deflector rolls 6, 7 and 8 serve for returning the carrier web 3T to the winding-up reel 4 which is coupled with the driving motor of the apparatus, mounted in the box 20, by means of a slipper clutch and a chain, the latter extending in a carrier arm 21. The slipper clutch (not shown) can be arranged likewise in the box 20, or it can be disposed immediately in front of the wind-up reel 4.

The illustrated apparatus embodiment is operated in the following manner:

When inserting a new storage reel 2, the composite adhesive web and carrier web 3K/3T is initially drawn by hand about the deflector roller 5 until it reaches the rollers 6 and 9. There, the adhesive web 3K is separated from the carrier web 3T and is guided about the deflecting and pre-folding roller 9 and through the pre-folding channel 10 to between the feed rollers 11*a* and 11*b*. Simultaneously, the carrier web 3T is guided about the deflector rollers 6, 7 and 8 and to the winding-up reel 4 where it is so fastened that it can be wound-up thereon. The differences in length of the paths of travel between the roller 9 and the pair of feed rollers 11*a*, 11*b* on the one hand, and between the roller 6 and the winding-up reel 4, on the other hand, are compensated for by the adhesive web 3K being conveyed correspondingly far beyond the roller pair 11*a*, 11*b*, e.g. by briefly switching on the drive means of these rollers. It is also possible to use instead an adhesive web/carrier web composite 3K/3T having a corresponding forerunning length of carrier web.

When the preceding end of the adhesive web 3K is located between the feed rollers 11*a* and 11*b* and the carrier web 3T is fastened at the circumference of the wind-up reel 4, the apparatus is ready for operation.

A sheet metal panel or band B an edge of which is to be protected by an adhesive web cover of U-shaped cross-section is now pushed with one of its corners past the web-guiding and folding member 10 forward between the feed rollers 11*a* and 11*b*, while the drive means are being switched on or have been switched on briefly prior thereto. The feed and press-on rollers 11*a* and 11*b* now pull the panel B through the gap betwen them, engaging it at marginal zones at its edge and at the same time pressing the adhesive web 3K of U-shaped cross-section on the edge and the adjacent marginal zones on each of the two panel sides. At the same tme the wind-up reel 4 which is driven by the motor in the box 20 via the slipper clutch, winds up the carrier web 3T. The slipper clutch is set in such a way that the pulling forces exerted respectively on the carrier web and on the adhesive web are about equal.

The apparatus according to the invention can be mounted stationarily, and the sheet metal panel can be guided by hand or with the aid of a robot. Invertedly, the panel can be held stationary during the process of applying the protective adhesive web, and the apparatus according to the invention can be guided along its edge, by hand, motor-driven along a rail, or with the aid of a robot. The former variant of application is recommended for treating smaller sheet metal pieces, the latter for larger ones.

The distance A1 between the swivel axis S2 of the casing 13 and a plane E defined by the shafts 12*a* and 12*b* of the feed and press-on rollers 11*a* and 11*b* is a controlling factor in determining the maximal admissible spatial curvature of the sheet metal part B. The smaller the curvature radius of the narrowest curvature of the sheet metal piece, the smaller must the distance A1 be chosen. It has been found that, in the case of a narrowest permissible radius of the sheet curvature $R_{min}$ being 20 mm, the distance A1 must be chosen as smaller than or equal with 7 mm. Under these conditions, sheet metal parts having curved portions of a curvature radius $R_{min}$ of 20 mm can just be drawn in an unobjectionable manner, i.e. free from binding, by the feed rollers 11*a* and 11*b* through the V-shaped exit slot 10*b* of the pre-folding channel means 10. In doing so, the feed roller pair 11*a*, 11*b* will assume the position shown in FIG. 3. Depending on the degree and orientation of the curvature in the sheet metal piece, the roller pair 11*a*, 11*b* will be inclined more or less strongly away from its central or neutral position N. The differences of travel thereby occurring at the feed and press-on rollers 11*a* and 11*b* are compensated by the torsional elasticity of the driving shafts 14*a* and 14*b*, respectively.

The distance A2 between the deflecting and pre-folding roller 9, which initiates the folding of the adhesive web 3K, and the V-shaped cross-section of the exit slot 10*b* of the pre-folding channel means 10 is set at such length, or is so adjusted, that folding of the adhesive web through this distance takes place substantially continuously and increasingly, with the V-angle continuously decreasing. Too large a distance A2 would have the drawback that the folding initiated by the roller 9 would have disappeared again before reaching the pre-folding channel means 9 which have the task of continuing and completing the folding of the adhesive web 3K, or that, in an extreme case, the web 3K would enter the pre-folding channel means 9 with inverted, i.e. "wrong" folding. Moreover, too large a distance A2 would also be a drawback, because the applied adhesive webs are, as a rule, highly plastic, so that long stretches of pull exerted on them should be avoided. When the distance A2 is too short, distortions of the adhesive web may occur.

The feed roller pair 11*a*, 11*b* and/or the casing 13 are adapted to irregularities in the contours of the sheet metal edge by resiliently backing away in rearward direction (double arrow H13-HF13 in FIG. 1). The deflecting and pre-folding roller 9 will do so in an analogous manner (double arrow H9-HF9 in FIG. 1).

The apparatus according to the invention was tested with adhesive foils marketed by CIBA-GEIGY AG, Basel, Switzerland under the commercial names "Klebfilm DLS 615" and "Klebfilm XB 3615". These adhesive webs have as base an epoxy resin single component system of satisfactory storage life at reduced temperatures (refrigeration) and harden rapidly at about 120° C. The foils are so composed that they are adhesive on one of their faces at room temperature (20° C.). These webs 3K are about 16 mm wide and about 0.30 to 0.35 mm thick. The carrier web 3T is made of paper and slightly wider. When pulled off a storage reel 2, the carrier web adheres to the adhesive face of the foil, and the adhesive web 3K will be folded, after drawing off the carrier web 3T, with its adhesive side on the inside and is thus applied to the sheet metal panel or band 3 with the aid of the feed and press-on rollers 11*a* and 11*b*.

Adhesive webs made of DLS 615 or XB 3615 are highly cohesively plastic and are practically free from inherent stiffness; they have only a very low tensile strength.

The illustrated embodiment of the apparatus according to the invention was built with, and set for, the following dimensions in order to satisfactorily apply a web of DLS 615 or XB 3615 of the above-mentioned cross section (width×thickness=16×0.30 $mm^2$) to a shaped sheet metal part B having curvature radii of minimaly 20 mm:

Diameter and height of the deflecting and pre-folding roller 9: 16 and 18 mm
V-angle of the roller 9: ca. 160° mm
Diameter of each feed and press-on roller 11*a* or 11*b*: 20 mm
Speed of each feed and press-on roller 11*a*, 11*b*: 32 r.p.m.
Distance A1 (S2—E): 7 mm
Distance A2 (9—10*b*): 30 mm
Length A3 of the pre-folding channel in 10: ca. 12 mm
V-angle at 10*a*: ca. 95°
V-angle at 10*b*: ca.12°
Radius of curvature (round-off) of the V-angle in 10*b*: ca. 3 mm.

What is claimed is:

1. An apparatus for applying an adhesive web longitudinally and with U-shaped cross section about the edge of a panel or the like shaped part of sheet metal, being equipped with web-guiding means comprising a funnel-like pre-folding channel having an entry end, an exit end and a central longitudinal axis therethrough; a pair of feed and press-on rollers each of which rollers comprises a feed roller shaft being spring-biassed to press one roller against the other, said feed and press-on rollers being adapted for receiving between them a pre-folded adhesive web emerging from said pre-folding channel and for pressing said pre-folded adhesive web against an edge and against the opposite sides adjacent said edge, of said shaped part of sheet metal, while said part is being introduced into contact with said folded adhesive web; bearing means on which said pair of feed and press-on rollers is pivotally mounted to be swivable as a unit about a common swivel shaft, said swivel shaft having a longitudinal axis which extends parallel to said shafts of said feed and press-on rollers and is located, ahead of said roller pair, taken in the direction of travel of said sheet metal part and adhesive web between said feed and press-on rollers of said pair, at least approximately in the plane of symmetry of said pre-folding channel, said feed and press-on rollers being adapted for being driven by motor means and exerting on the sheet metal part, being pulled through said unit by said feed and press-on rollers, an at least approximately constant force of conveyance even when differences occur between the speeds of the two rollers of said pair.

2. The apparatus of claim 1, wherein the distance from said swivel axis, of said unit consisting of said roller pair, to a common plane extending through the axes of both roller shafts of said pair is at least approximately equal to the distance between said common plane and said exit end of said pre-folding channel.

3. The apparatus of claim 1 or 2, wherein said unit consisting of said pair of feed and press-on rollers is held resiliently in a neutral position relative to said exit end of said pre-folding channel, and has a unit plane of symmetry extending between the two rollers of said pair, which last-mentioned plane of symmetry coincides, in said neutral position, with said central longitudinal axis of said pre-folding channel.

4. The apparatus of claim 1, further comprising a web-deflecting roller so arranged directly ahead of said pre-folding channel, in the direction of travel of said adhesive web, as to act as a pre-folding roller on said adhesive web.

5. The apparatus of claim 4, wherein said pre-folding roller bears a profile which is weakly arcuate or V-shaped, said profile having a large profile angle enclosed by said arc or V, and having the zone of smallest diameter in the middle of the peripheral face of said pre-folding roller.

6. The apparatus of claim 5, wherein said profile angle is about 155° to 165°.

7. The apparatus of claim 1, wherein said pre-folding channel has a V-shaped cross-sectional area and the angle between the legs of said V is from about 90° to 100° at said entry end, and from about 10° to 15° at said exit end of said pre-folding channel.

8. The apparatus of claim 4, wherein said pre-folding channel has an effective channel length for the passage of said adhesive web therethrough while being pre-folded therein, and said deflecting and pre-folding roller has an effective width, said effective channel length amounting to from about 60 to 80% of said width.

9. The apparatus of claim 1, further comprising drive means comprising a common motor for driving said rollers of said pair, and at least one elastically twistable element coupled to said motor and drivingly connected to one of said rollers of said pair.

10. The apparatus of claim 9, wherein said elastically twistable element is a flexible and torsionally elastic shaft.

11. The apparatus of claim 1, wherein at least one of the two feed roller shafts is pivotally supported in said unit about a shaft pivot axis, and said unit comprises a spring urging the roller of said pivotally supported shaft against the other roller, the position of said shaft pivot axis being so adjustable that at a given distance of the rollers of said pair from one another said two roller shafts are exactly parallel with each other.

12. The apparatus of claim 4, wherein said web guiding means comprise a biassing spring and means for displacing said deflecting and pre-folding roller relative to said pre-folding channel in a direction transverse to the path through which said adhesive web travels when passing from said entry end to said exit end of said pre-folding channel, said biassing spring urging said deflecting and pre-folding roller toward said path.

13. The apparatus of claim 12, wherein the direction of displacement of said deflecting and pre-folding roller is at least substantially parallel to the roller shafts of said feed and press-on rollers of said pair.

* * * * *